US006183112B1

(12) United States Patent
Bomas

(10) Patent No.: US 6,183,112 B1
(45) Date of Patent: Feb. 6, 2001

(54) DIRECTIONAL LIGHTING FIXTURE

(76) Inventor: Bert C Bomas, 2895 Highway 49 West, Ashland City, TN (US) 37015

( * ) Notice: Under 35 U.S.C. 154(b), the term of this patent shall be extended for 0 days.

(21) Appl. No.: 09/217,515

(22) Filed: Dec. 21, 1998

(51) Int. Cl.[7] ..... F21V 21/26

(52) U.S. Cl. ..... 362/285; 362/153; 362/431; 362/306; 362/226; 362/298; 362/413

(58) Field of Search ..... 362/153, 431, 362/306, 226, 298, 413

(56) References Cited

U.S. PATENT DOCUMENTS 5,384,694 * 1/1995 Yang ..... 362/298
5,398,180 * 3/1995 Iee ..... 362/431
5,414,607 * 5/1995 Harris et al. ..... 362/362
5,488,550 * 1/1996 Yang ..... 362/298
5,567,045 * 10/1996 Bueck ..... 362/363
5,626,418 * 5/1997 Angelis, Sr. et al. ..... 362/390
6,062,713 * 5/2000 Renlger et al. ..... 362/477
6,106,134 * 8/2000 Bomas ..... 362/427

* cited by examiner

*Primary Examiner*—Sandra O'Shea
*Assistant Examiner*—Anabel M. Ton
(74) *Attorney, Agent, or Firm*—Michael I. Kroll

(57) ABSTRACT

A directional lighting fixture connected to a power source for illuminating an area. The lighting fixture includes a housing having a top side for receiving a light bulb, the light bulb extending therefrom and a canopy including a tubular member having a cavity cut therein and a rim extending around a top side of the tubular member and positioned above the cavity. A device is provided for adjustably securing the canopy to the top side of the housing. When the canopy is secured to the top side of the housing the light bulb is positioned at least partially within the cavity for producing a light beam able to pass through the cavity and out of the canopy for illuminating the desired area, a width of the light beam is dependent on the height at which the canopy is secured to the housing.

4 Claims, 6 Drawing Sheets

DIRECTIONAL LIGHTING FIXTURE

BACKGROUND OF THE INVENTION

FIELD OF THE INVENTION

The present invention relates generally to directional lighting fixtures and, more specifically, to an illumination device for providing aesthetically pleasing low wattage lighting to areas requiring directional lighting such as driveways, the device including a vertically adjustable canopy able to adjust the amount of light projecting to the horizon.

SUMMARY OF THE PRESENT INVENTION

The present invention relates generally to directional lighting fixtures and, more specifically, to an illumination device for providing aesthetically pleasing low wattage lighting to areas requiring directional lighting such as driveways, the device includes a vertically adjustable canopy able to adjust the amount of light projecting to the horizon.

A primary object of the present invention is to provide a directional lighting fixture that will overcome the shortcomings of prior art devices.

Another object of the present invention is to provide a directional lighting fixture which is able to provide adequate lighting to a desired area such as paths and sidewalks or to accent the landscape of a property.

A further object of the present invention is to provide a directional lighting fixture including a vertically adjustable canopy for varying an amount of light provided thereby.

A yet further object of the present invention is to provide a directional lighting fixture wherein the canopy includes an aperture through which light is directed.

A still further object of the present invention is to provide a directional lighting fixture including a reflective surface within the canopy for projecting a light beam through the aperture in the canopy and into the horizon.

An even further object of the present invention is to provide a directional lighting fixture wherein the aperture has a cover extending thereover, the cover being of any desired color to thereby tint the light produced by the device.

Another object of the present invention is to provide a directional lighting fixture that is simple and easy to use.

A yet further object of the present invention is to provide a directional lighting fixture that is economical in cost to manufacture.

Additional objects of the present invention will appear as the description proceeds.

A directional lighting fixture connected to a power source for illuminating an area is disclosed by the present invention. The lighting fixture includes a housing having a top side for receiving a light bulb, the light bulb extending therefrom and a canopy including a tubular member having a cavity cut therein and a rim extending around a top side of the tubular member and positioned above the cavity. A device is provided for adjustably securing the canopy to the top side of the housing. When the canopy is secured to the top side of the housing the light bulb is positioned at least partially within the cavity for producing a light beam able to pass through the cavity and out of the canopy for illuminating the desired area, a width of the light beam is dependent on the height at which the canopy is secured to the housing.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
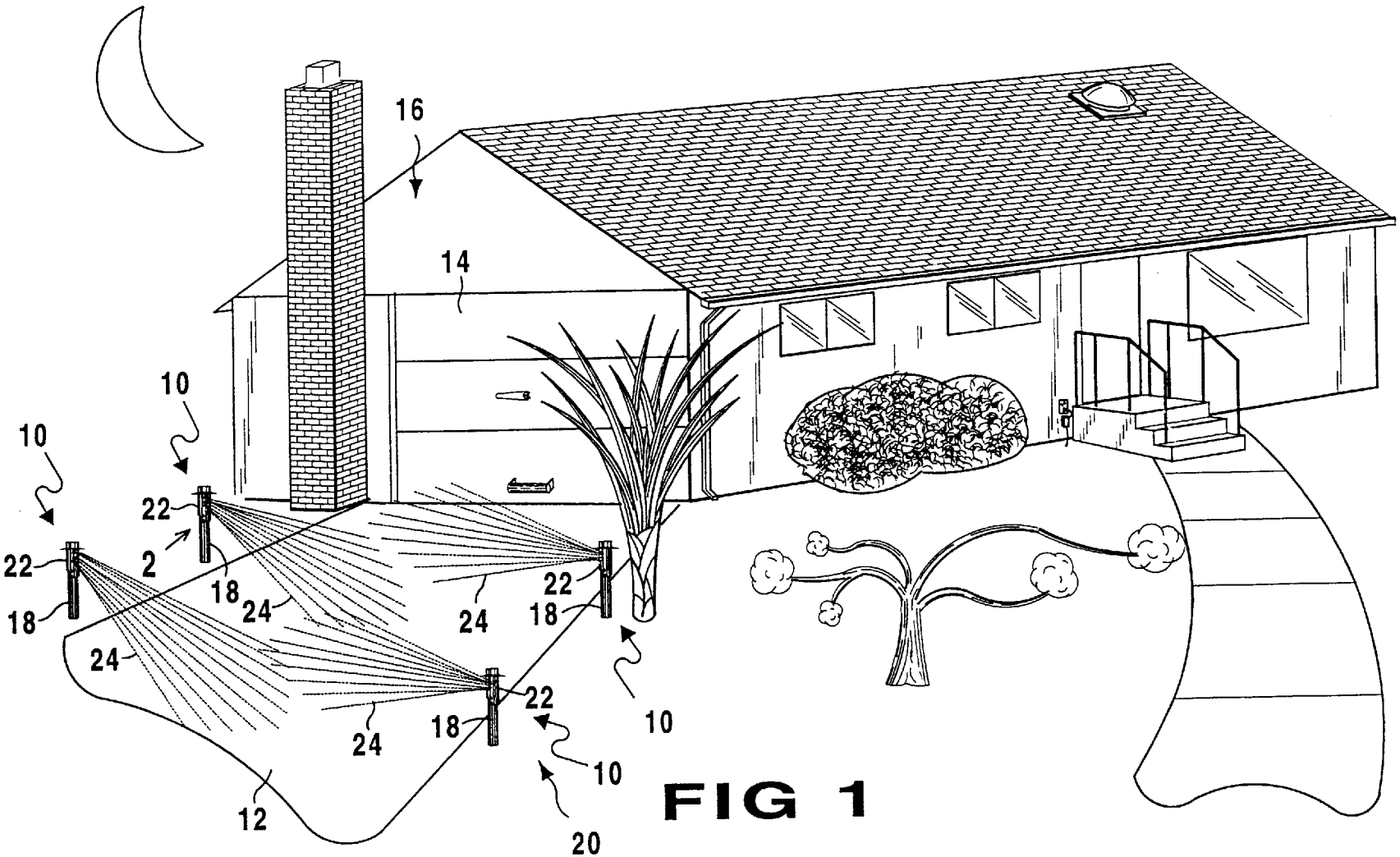
FIG. 1 is a perspective view of an outdoor area being illuminated by the directional lighting fixture of the present invention.

Turning now descriptively to the drawings, in which similar reference characters denote similar elements throughout the several views, the Figures illustrate directional lighting fixture of the present invention. With regard to the reference numerals used, the following numbering is used throughout the various drawing figures.

10 directional lighting fixture of the present invention

12 driveway

14 garage door

16 house

18 tubular housing

20 ground

22 canopy

24 dashed lines indicating direction at which light is projected

26 slanted bottom side of housing

28 top side of housing

30 vertically aligned holes in top side of housing
32 light bulb
34 tubular member of canopy
36 rim extending around top side of tubular member
38 recess in bottom side of canopy
40 bottom side of canopy
42 pin for releasably securing canopy to housing
44 cavity in tubular member
46 cover of cavity
48 recess in housing for electrical cord
50 electrical cord
52 elastomeric ring surrounding recess
54 adapter on end of electrical cord
56 first prong of adapter
58 second prong of adapter
60 electrically conductive end of first prong
62 electrically conductive end of second prong
64 arrow indicating movement of first prong for connection with electrical raceway
66 arrow indicating movement of second prong for connection with electrical raceway
68 dashed lines indicating light beam produced by aligning recess in tubular member with topmost recess in housing
70 dashed lines indicating light beam produced by aligning recess in tubular member with a middle one of recesses in housing
72 dashed lines indicating light beam produced by aligning recess in tubular member with bottommost recess in housing

DETAILED DESCRIPTION OF THE PREFERRED EMBODIMENT

Turning now descriptively to the drawings, in which similar reference characters denote similar elements throughout the several views, FIGS. 1 through 6C illustrate the directional lighting fixture of the present invention indicated generally by the numeral 10.

The directional lighting fixture 10 is illustrated in FIG. 1. In this figure a number of directional lighting fixtures 10 are positioned along a driveway 12 leading to a garage door 14 of a house 16. Each of the directional lighting fixtures 10 are able to illuminate a portion of the driveway 12. Each directional lighting fixture 10 includes a tubular housing 18 which is inserted in the ground 20 and extends substantially vertically therefrom. A vertically adjustable canopy 22 is releasably connected to an end of the tubular housing 18 opposite the ground 20. The vertical position of the canopy 22 determines the amount of illumination provided by the directional lighting fixture 10, the direction at which the light is reflected and the distance to which the light will project. The projection of the light is indicated by the lines 24 emanating from each of the directional lighting fixtures 10.

Use of the directional lighting fixture 10 of the present invention is not limited to illumination of a driveway 12 of a house 16 but may be used to illuminate any walkway or driveway such as a sidewalk, path through a yard or even paths within a park.

Figure 2:
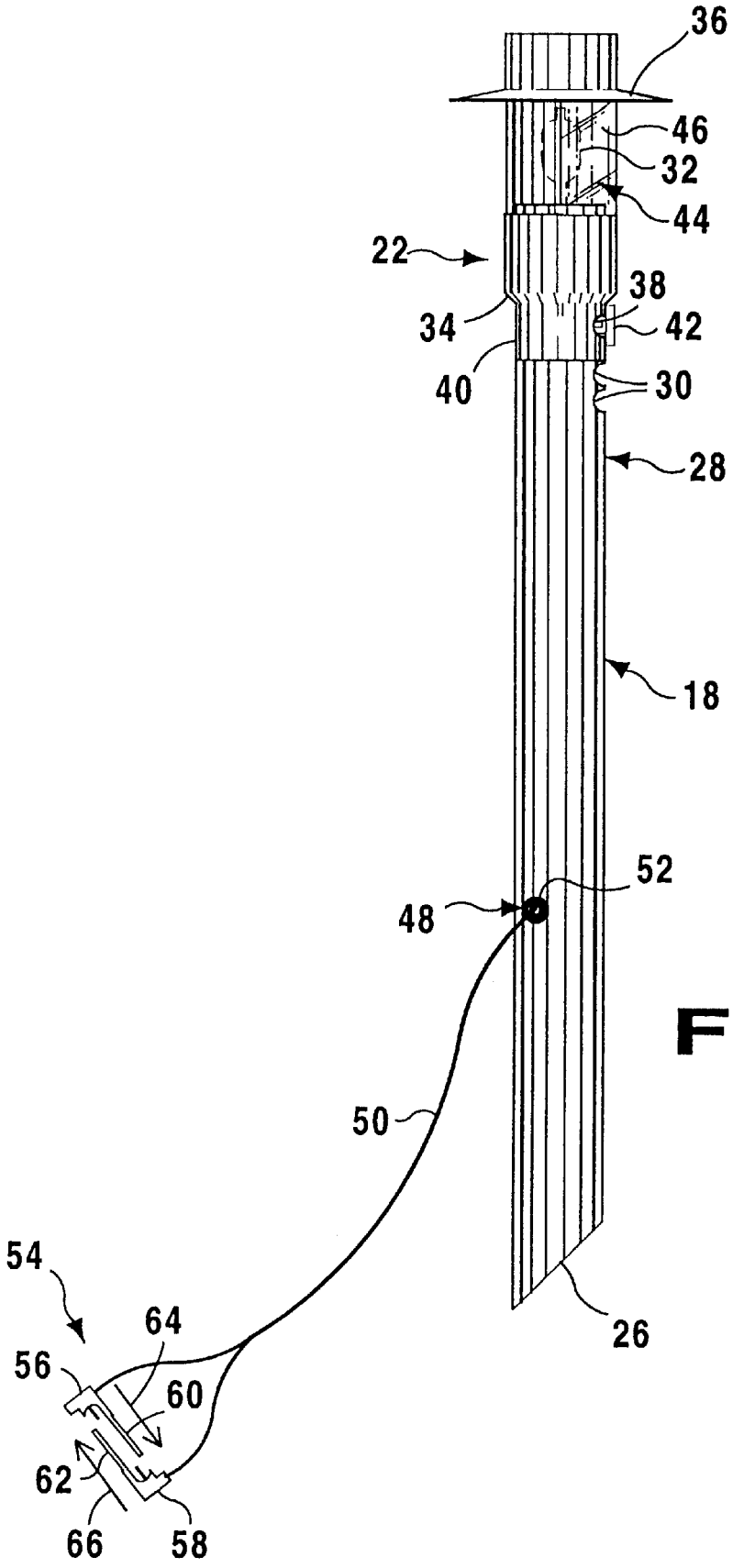
FIG. 2 is a side view of the directional lighting fixture of the present invention.

A side view of the directional lighting fixture 10 is illustrated in FIG. 2. As can be seen from this figure, the directional lighting fixture 10 includes a substantially tubular housing 18 having a slanted bottom side 26 for aiding the user in inserting the directional lighting fixture 10 into the ground 20. At a top side 28 of the housing 18 are a plurality of vertically aligned recesses 30. A light bulb 32 is positioned to extend from a light socket positioned in the top side 28. The socket is not illustrated in the drawings and the light bulb 32 is shown in dashed lines and positioned to extend from the top side 28 of the tubular housing 18 and into the canopy 22 when positioned atop the housing 18.

The canopy 22 includes a tubular member 34 and a rim 36 extending therearound at a top side of the tubular member 34. The tubular member 34 is hollow and includes a recess 38 extending through a bottom side 40 thereof. The top side 28 of the housing 18 is received within the tubular member 34 when the directional lighting fixture 10 is assembled for use. Alternatively, the top side 28 of the housing 18 may receive the tubular member 34 therein when the directional lighting fixture 10 is assembled for use. The tubular member 34 is releasably connected to the housing 18 by insertion of a pin 42 through the recess 38 and a selected one of the vertically aligned recesses 30 extending through the top side 28 of the housing 18. A cavity 44 is cut through a portion of the tubular member 34 providing egress for the light produced by the light bulb 32 when the canopy 22 is positioned atop the housing 18. A cover 46 may be positioned over the cavity 44 for protecting the light bulb 32 and preventing the inside of the directional lighting fixture 10 from being affected by the ambient atmosphere.

Extending through a recess 48 in the housing 18 is an electrical power cord 50. The recess 48 is preferably covered by an elastomeric ring 52 for sealing the recess 48 and preventing anything from entering the housing 18 through the recess 48 which may harm the operation of the directional lighting fixture 10. At an end of the electrical power cord 50 is an adapter 54. The adapter 54 includes first and second prongs 56 and 58 for piercing and connection to an electrical raceway (not shown). Each of the first and second prongs 56 and 58 include an electrically conductive end 60 and 62, respectively, for contacting the electrical wires within the raceway to which they will be connected. When connecting the adapter 54 to the electrical raceway the first prong 56 is moved in the direction of the arrow labeled with the numeral 64 such that the electrically conductive end 60 pierces the covering of the electrical raceway and contacts the conductive wires extending therethrough. The second prong 58 is moved in the direction of the arrow labeled with the numeral 66 such that the electrically conductive end 62 pierces the covering of the electrical raceway and contacts the conductive wires extending therethrough. The opposite end of the electrical power cord 50 is connected to a socket for receiving the light bulb 32.

The amount of light allowed to exit through the cavity 44 and the angle at which the light is directed is determined by the height at which the canopy 22 is releasably secured to the housing 18. The height of the canopy 22 is dependent upon which of the vertically aligned recesses 30 is selected for receiving the pin 42. Selection of the lowest of the recesses 30 allows the least amount of light to pass through the cavity 44 in the tubular member 34 whereby the rim 36 directs the light impingent thereon to be directed in a narrow beam. Selection of the highest one of the recesses 30 allows the greatest amount of light to pass through the cavity 44 whereby the rim 36 directs the light impingent thereon to project in a wide beam.

Figure 3:
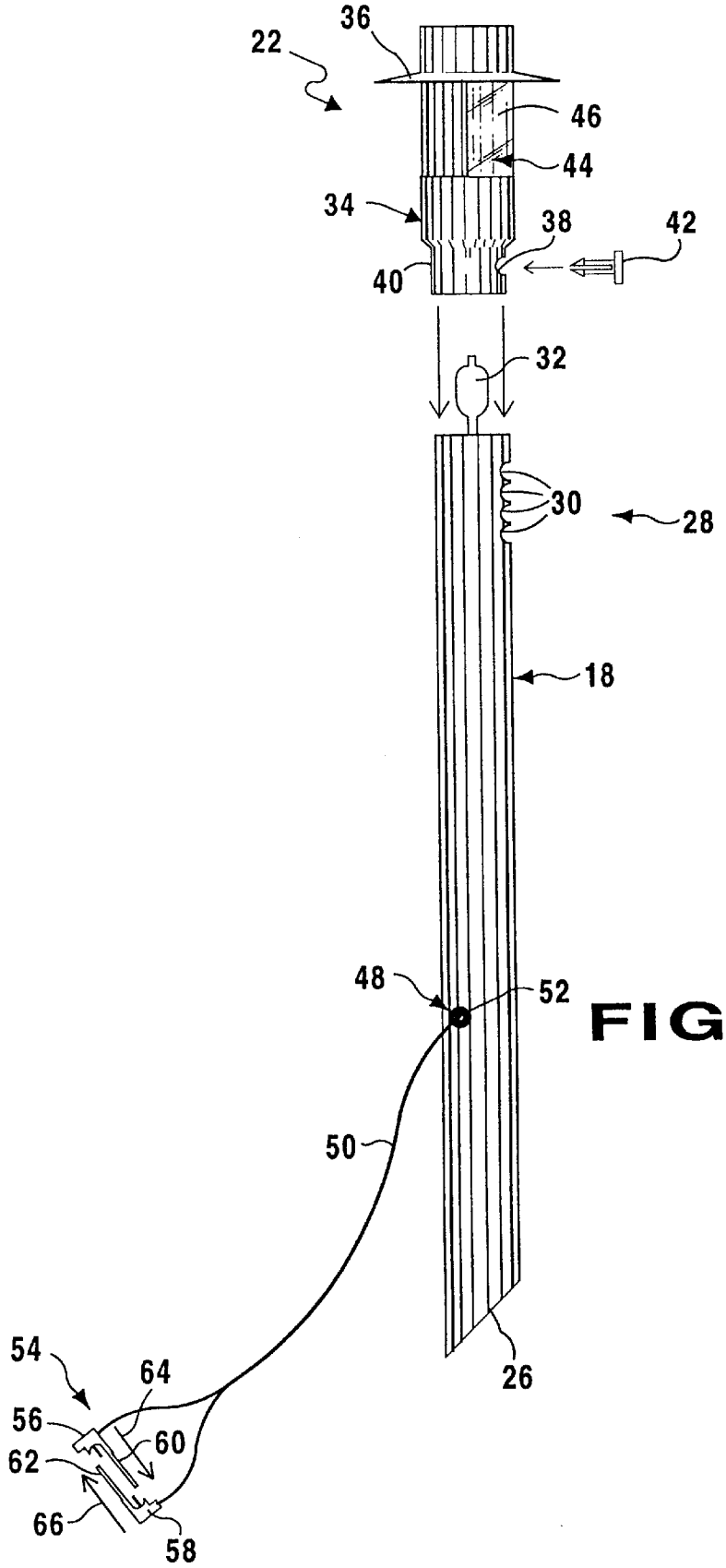
FIG. 3 is an exploded side view of the directional lighting fixture of the present invention.

An exploded view of the directional lighting fixture 10 is illustrated in FIG. 3. As can be seen from this figure, the cylindrical housing 18 is hollow and includes a slanted bottom side 26 and a flat top side 28. A plurality of vertically aligned recesses 30 extend through the top side 28 of the housing 18. Extending from the top side 28 of the housing 18 is the light bulb 32.

The canopy 22 includes the tubular member 34 and the rim 36 extending around the top side of the tubular member 34. The tubular member 34 includes a recess 38 on the lower end 40 thereof. The lower end 40 of the tubular member 34 is releasably positioned within the top side 28 of the housing 18 so that the recess 38 is aligned with one of the plurality of vertically aligned recesses 30 in the top side 28 of the housing 18. The pin 42 is releasably inserted through the one of the vertically aligned recesses 30 and the recess 38 for releasably securing the canopy 22 atop the housing 18 at a desired height. The tubular member 34 includes the cavity 44 cut therein with the cover 46 positioned thereover for allowing egress of light produced by the light bulb 32 therethrough. The rim 36 reflects a portion of the light passing through the cavity 44 and cover 48 to define the width of the beam projected by the directional lighting fixture 10. The amount of light and the width of the beam being projected thereby is dependent upon the height at which the canopy 22 is positioned on the housing 18. The height of the canopy 22 is dependent upon which of the vertically aligned recesses 30 is aligned with the recess 38 in the bottom side 40 of the tubular member 34.

Extending from the housing 18 is the electrical power cord 50. The electrical power cord 50 includes the adapter 54 for connection to an electrical raceway which may extend along the path to be illuminated for supplying electricity to the directional lighting fixtures 10. The adapter 54 includes the first and second prongs 56 and 58 each including an electrically conductive end 60 and 62 able to pierce the cover of the electrical raceway and provide power to the light bulb 32 of the directional lighting fixture 10.

Figure 4:
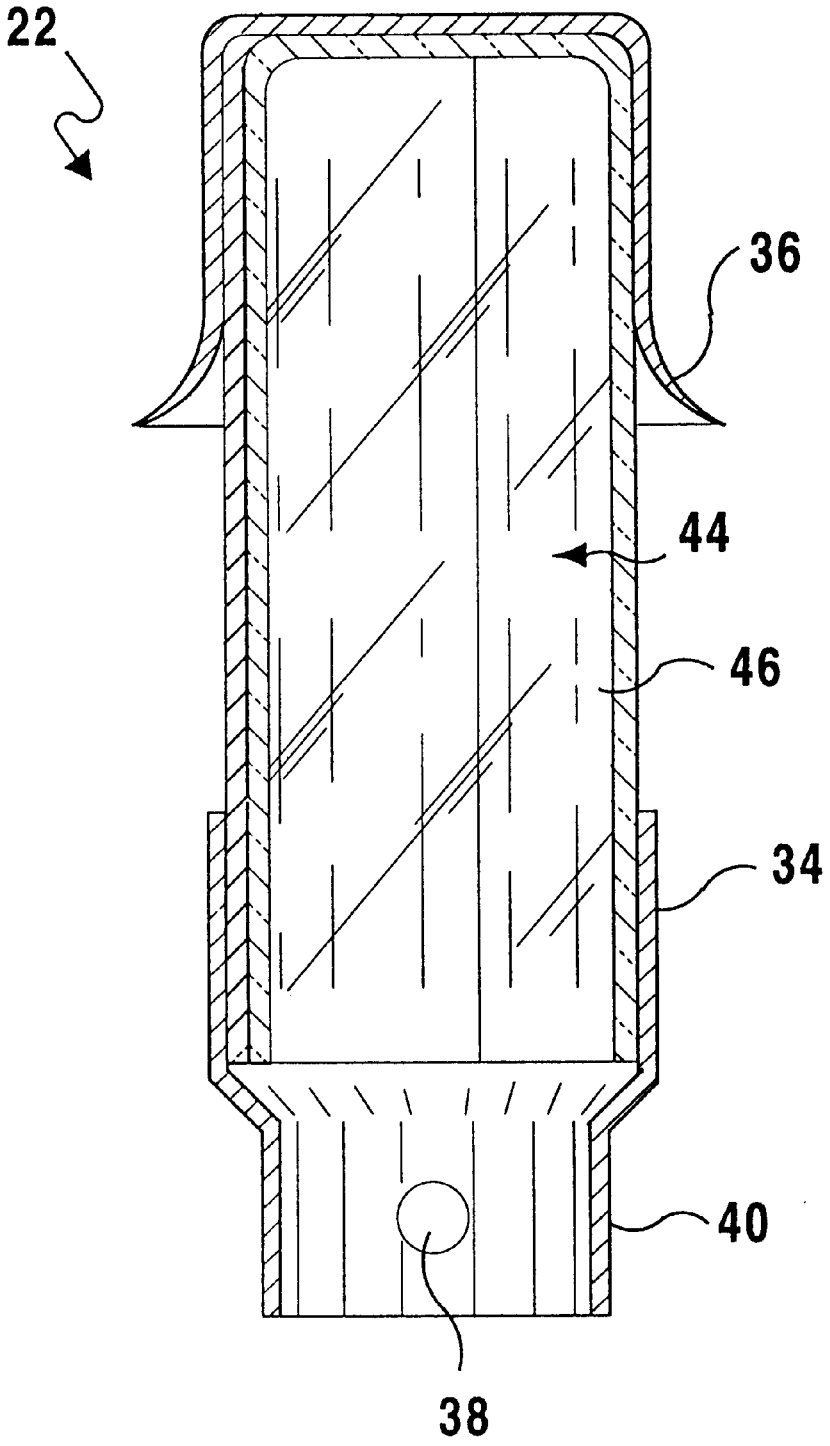
FIG. 4 is a cross-sectional side view of the adjustable canopy of the directional lighting fixture of the present invention.

An enlarged cross-sectional view of the canopy 22 is illustrated in FIG. 4. As can be seen from this figure, the canopy 22 includes the tubular member 34 and the rim 36 extending therearound in a position above the cavity 44. The rim is positioned to define the upper limit for the projected light beam exiting the cavity 44 and thus defines the width of the beam being projected. The rim also acts to slightly reflect the light downward towards the surface being illuminated. The cavity 44 is cut into the tubular member 34 and extends substantially halfway around the circumference of the tubular member 34. The cover 46 is positioned over the cavity 44 so as to close the tubular member 34 to the ambient atmosphere.

Figure 5C:
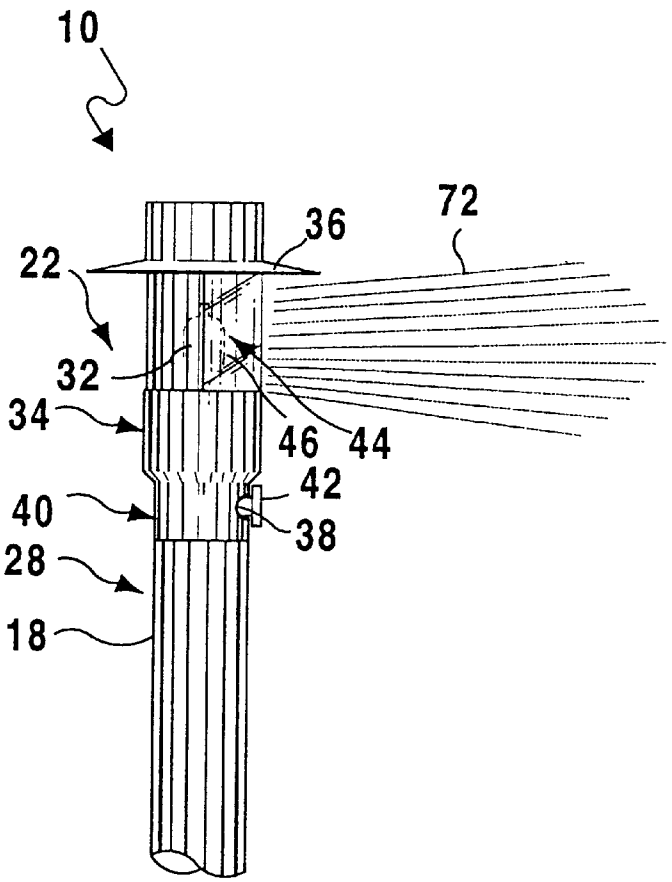
FIG. 5C is a side view of the directional lighting fixture of the present invention having the canopy set at a third height.
Figure 5B:
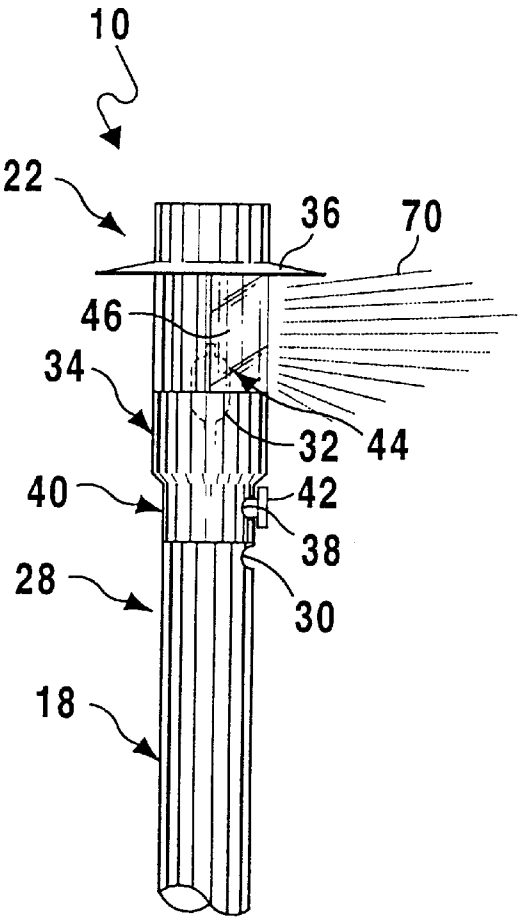
FIG. 5B is a side view of the directional lighting fixture of the present invention having the canopy set at a second height.
Figure 5A:
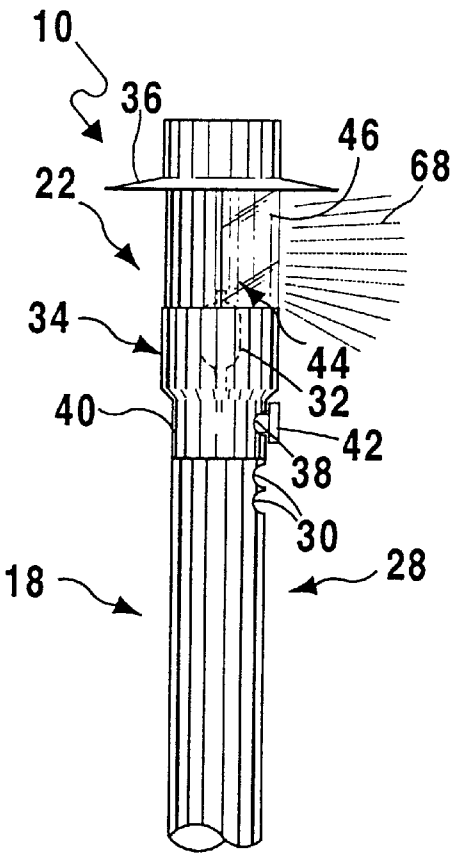
FIG. 5A is a side view of the directional lighting fixture of the present invention having the canopy set at a first height.

FIGS. 5A, 5B and 5C illustrate the directional lighting fixture 10 projecting light produced thereby at different angles and different beam widths. The different beam widths determine the distance of projection of the light for illuminating the desired area. In FIG. 5A the canopy 22 is secured to the housing 18 whereby the top one of the vertically aligned recesses 30 is aligned with the recess 38 extending through the tubular member 34. In this position the entire light bulb is received within the cavity 44. The light passing through the cover 46 is barely reflected by the rim 36 and a wide beam of light is projected from the cavity 44. The light beam is thus able to provide a wide beam covering a short distance and thus illuminates the immediate area surrounding the directional lighting fixture 10. The light beam produced by the positioning of the canopy 22 as illustrated in FIG. 5A is indicated by the dashed lines labeled with the numeral 68. The canopy 24 positioned as shown in FIG. 5A provides light for the greatest area possible with the directional lighting fixture 10.

FIG. 5B illustrates the canopy 22 positioned such that the recess 38 in the tubular member 34 is aligned with a centrally located one of the vertically aligned recesses 30. In this position, a portion of the light bulb 32 extends above the cavity 44 and thus all the light produced does not pass out of the cavity 44. A smaller more concentrated beam of light is caused to pass out of the cavity 44 and through the cover 46 than the light beam passing out of the cavity 44 when the canopy 24 is positioned as shown in FIG. 5A. The light beam projected by directional lighting fixture 10 with the recess 38 in the canopy 22 aligned with a centrally located one of the vertically aligned recesses 30 is indicated by the dashed lines labeled with the numeral 70.

FIG. 5C illustrates the canopy 22 positioned such that the recess 38 in the tubular member 34 is aligned with the bottom one of the vertically aligned recesses 30. In this position a minimum area of the light bulb 32 is within the cavity 44 and thus most of the light produced by the light bulb 32 will not pass through the cavity 44. Positioning the canopy 22 in this manner projects a very narrow beam of light out of the cavity 44 and through the cover 46. The projected light beam is shown in FIG. 5C and identified by the numeral 72.

The directional lighting fixture 10 may be adapted to provide illumination of an area or path with different colored or tinted lights to thereby change the tint of the produced light to a desired color. This effect can be created by using a colored light bulb 32 with a clear transparent cover 46 over the cavity 44 or using a colored cover 46 positioned over the cavity 44. Use of such a light bulb 32 or cover 46 would produce a tinted light which may be desirable for decorative purposes.

The directional lighting fixture 10 is designed to work in conjunction with one or more additional directional lighting fixtures 10 to provide aesthetically pleasing low wattage lighting to areas requiring directional lighting such as driveways. The illumination device is made of a durable and possibly decorative material, e.g. polished copper. The hat-like canopy member is preferably made from the same material as the housing.

Figure 6C:
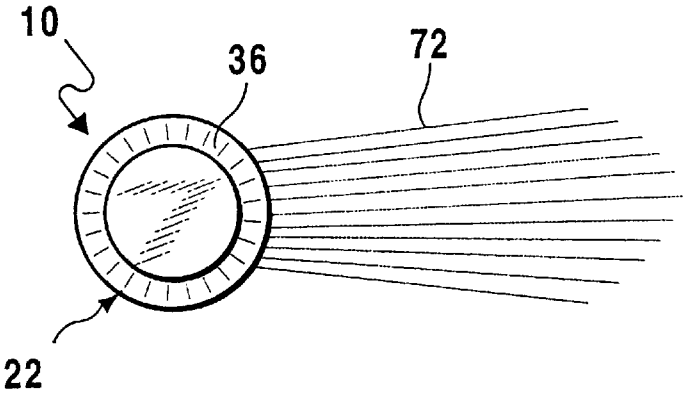
FIG. 6C is a top cross-sectional view of the directional lighting fixture of the present invention illustrating the effect on the light beam with the canopy set at the third height.
Figure 6B:
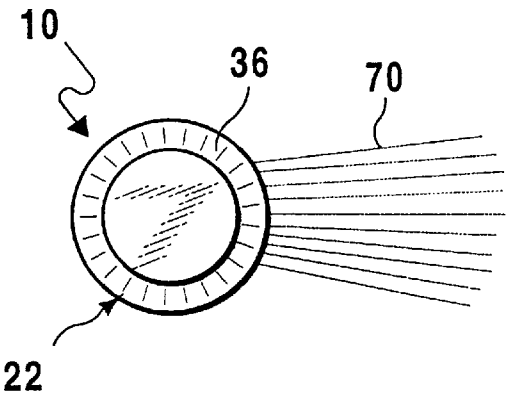
FIG. 6B is a top cross-sectional view of the directional lighting fixture of the present invention illustrating the effect on the light beam with the canopy set at the second height.
Figure 6A:
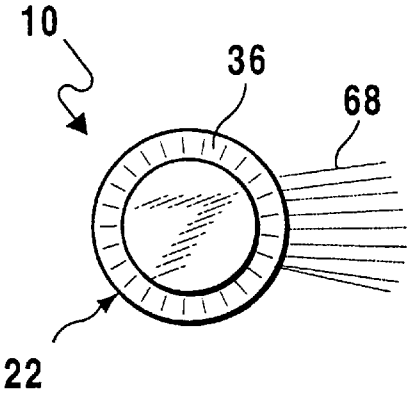
FIG. 6A is a top cross-sectional view of the directional lighting fixture of the present invention illustrating the effect on the light beam with the canopy set at the first height.

A top cross-sectional view of the directional lighting fixture 10 is illustrated in FIGS. 6A, 6B and 6C. FIG. 6A illustrates the canopy 22 connected to the housing 18 in the position shown in FIG. 5A. the projected light beam is indicated by the numeral 68. FIG. 6B illustrates the canopy 22 connected to the housing 18 in the position shown in FIG. 5B. the projected light beam is indicated by the numeral 70. FIG. 6C illustrates the canopy 22 connected to the housing 18 in the position shown in FIG. 5C. the projected light beam is indicated by the numeral 72.

The operation of the directional lighting fixture 10 will now be described with reference to the figures. In operation, the directional lighting fixture 10 is first assembled by placing the desired color light within the socket positioned at the top end 28 of the housing 18. The desired color cover 46 is then selected and is secured to cover the cavity 44. The desired height of the canopy 22 for producing the desired light beam for covering the desired amount of area is now selected. Once selected, the one of the vertically aligned recesses 30 which would need to be aligned with the recess 38 in the tubular member 34 is selected and that recess 30 is aligned with the recess 38. The securing pin 42 is then inserted through the aligned recesses. The directional lighting fixture 10 is now ready for use.

The user will now select a desired location for the directional lighting fixture 10 and secure the directional lighting fixture 10 in position by inserting the slanted bottom side 26 into the ground. The prongs 56 and 58 of the adapter 54 are now connected with the electrical raceway and the directional lighting fixture 10 may now be turned on to illuminate the desired area. Any additional directional lighting fixtures 10 needed to illuminate the desired area are then assembled and positioned in the same manner as described above.

When a light bulb 32 burns out, the canopy 22 may be removed by releasing the pin 42 and lifting the canopy 22 off the housing 18. The light bulb 32 may then be changed in the manner used for changing any conventional light bulb and the canopy 22 can then be reconnected to the housing by re-aligning the recess 38 with a desired one of the vertically aligned recesses 30 and inserting the pin 42 therethrough.

From the above description it can be seen that the directional lighting fixture of the present invention is able to overcome the shortcomings of prior art devices by providing a directional lighting fixture which is able to provide adequate lighting to a desired area such as paths and sidewalks or to accent the landscape of a property. The directional lighting fixture includes a vertically adjustable canopy for varying an amount of light provided by the device, the canopy having an aperture through which light is directed. The directional lighting fixture further includes a reflective surface within the canopy for projecting a light beam produced thereby through the aperture and into the horizon and a cover extending thereover, the cover being of any desired color to thereby tint the light produced by the device. Furthermore, the directional lighting fixture of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lighting fixture connected to a power source for illuminating an area, said lighting fixture comprising:

a) a housing including a first end, a second end and a socket for receiving a light bulb positioned in said first end;

b) a canopy including a hemispherical member having a first reflective side and a vertical member having a cavity cut through a portion thereof extending through a central portion of said hemispherical member;

c) means for adjustably securing said vertical member to said first end of said housing whereby the light bulb within said socket is at least partially positioned within said cavity such that light produced by the light bulb at least partially passes through said cavity and is reflected by said reflective side of said hemispherical member to illuminate the desired area; and d) said means for adjustably securing includes a plurality of vertically aligned recesses extending through said first end of said housing, a recess extending through said vertical member and a pin releasably positioned to extend through a selected one of said plurality of vertically aligned recesses and said recess extending through said vertical member.

2. A lighting fixture connected to a power source for illuminating an area, said lighting fixture comprising:

a) a housing including a first end, a second end and a socket for receiving a light bulb positioned in said first end;

b) a canopy including a hemispherical member having a first reflective side and a vertical member having a cavity cut through a portion thereof extending through a central portion of said hemispherical member;

c) means for adjustably securing said vertical member to said first end of said housing whereby the light bulb within said socket is at least partially positioned within said cavity such that light produced by the light bulb at least partially passes through said cavity and is reflected by said reflective side of said hemispherical member to illuminate the desired area; and d) said means for adjustably securing each of said plurality of lighting fixtures includes a plurality of vertically aligned recesses extending through said first end of said housing, a recess extending through said vertical member and a pin releasably positioned to extend through a selected one of said plurality of vertically aligned recesses and said recess extending through said vertical member.

3. A lighting fixture connected to a power source for illuminating an area, said lighting fixture comprising:

a) a housing including a first end, a second end and a socket for receiving a light bulb positioned in said first end;

b) a canopy including a hemispherical member having a first reflective side and a vertical member having a cavity cut through a portion thereof extending through a central portion of said hemispherical member;

c) means for adjustably securing said vertical member to said first end of said housing whereby the light bulb within said socket is at least partially positioned said cavity such that light produced by the light bulb at least partially passes through said cavity and is reflected by said reflective side of said hemispherical member to illuminate the desired area; and d) a cover for covering said cavity to thereby protect the light bulb wherein said cover is of a desired color to provide a tint to light passing through said cavity.

4. A lighting fixture connected to a power source for illuminating an area, said lighting fixture comprising:

a) a housing including a first end, a second end and a socket for receiving a light bulb positioned in said first end;

b) a canopy including a hemispherical member having a first reflective side and a vertical member having a cavity cut through a portion thereof extending through a central portion of said hemispherical member;

c) means for adjustably securing said vertical member to said first end of said housing whereby the light bulb within said socket is at least partially positioned within said cavity such that light produced by the light bulb at least partially passes through said cavity and is reflected by said reflective side of said hemispherical member to illuminate the desired area; and d) each of said plurality of lighting fixtures further comprises a cover for covering said cavity to thereby protect the light bulb and wherein said cover of each of said plurality of lighting fixtures is of a desired color to provide a tint to light passing through said cavity.

* * * * *